US007290421B2

(12) United States Patent
Field et al.

(10) Patent No.: US 7,290,421 B2
(45) Date of Patent: Nov. 6, 2007

(54) VARIABLE CURVATURE TUBE AND DRAW DIE THEREFOR

(75) Inventors: David A. Field, Birmingham, MI (US); William Hugh Frey, Grosse Pointe Farms, MI (US)

(73) Assignee: General Motors Corporation, Detroit, MI (US)

( * ) Notice: Subject to any disclaimer, the term of this patent is extended or adjusted under 35 U.S.C. 154(b) by 362 days.

(21) Appl. No.: 10/611,842

(22) Filed: Jul. 1, 2003

(65) Prior Publication Data

US 2005/0000261 A1 Jan. 6, 2005

(51) Int. Cl.
*B21D 7/04* (2006.01)

(52) U.S. Cl. ..... 72/149; 72/146

(58) Field of Classification Search ..... 72/149, 72/150, 151, 152, 153, 154, 155, 156, 157, 72/214, 215, 216, 217, 218, 219, 369, 370.01, 72/370.02, 370.03, 159, 467; 474/140
See application file for complete search history.

(56) References Cited

U.S. PATENT DOCUMENTS 1,714,083 A * 5/1929 Frank ..... 72/153
1,731,087 A * 10/1929 Zatti ..... 72/155
2,822,023 A * 2/1958 Ahern ..... 72/20.3
3,785,190 A * 1/1974 Schall et al. ..... 72/149
4,416,136 A * 11/1983 Schwarze ..... 72/157
4,492,304 A * 1/1985 Geis ..... 198/837
4,843,858 A * 7/1989 Grimm et al. ..... 72/149
5,127,248 A * 7/1992 Sanseau et al. ..... 72/149
5,306,212 A * 4/1994 Eberle ..... 474/140
5,463,888 A * 11/1995 Nagai ..... 72/157
6,607,021 B1 * 8/2003 Rahmfeld ..... 164/441
2005/0145002 A1 * 7/2005 Field et al. ..... 72/146

FOREIGN PATENT DOCUMENTS

GB 2256384 A * 12/1992

* cited by examiner

*Primary Examiner*—Dmitry Suhol

(57) ABSTRACT

A tube is bent having a curved portion with a variable radius extending between first and second ends. The curved portion includes a circular arc portion with a constant radius and a clothoid transition portion with a variable radius. The circular arc portion extends from the first end toward a point of integration. At the point of integration, the circular arc portion merges with the transition portion. The transition portion extends from the point of integration to the second end. As the transition portion extends from the point of integration, its radius of curvature increases over its arc length, thereby, improving the quality of the bent tube by gradually bending the tube over a longer distance, thereby reducing local stresses on the bent portion of the tube.

5 Claims, 2 Drawing Sheets

VARIABLE CURVATURE TUBE AND DRAW DIE THEREFOR

TECHNICAL FIELD

This invention generally relates to tubular bending and, more particularly, to configurations for bending tubes.

BACKGROUND OF THE INVENTION

Tube bending is known in the art and typically involves bending an elongated metal tube with a rotary die. As the tube is bent around the draw die, the tube undergoes an abrupt change from a straight tube with curvature equal to zero in its axial direction to a tube with positive and constant curvature of the circular bend. The abrupt change causes a portion of the tube contacting the surface of the die to compress, while a portion of the tube opposite the surface of the die stretches. As a result, the bending can create folds or oscillations on the bent portion of the tube.

Bending a tube around a draw die may also deform cross sections of the tube to non-circular shapes. To prevent deformation of the tube, a mandrel is inserted into the tube to reinforce the wall of the tube and help prevent the tube from becoming deformed. However, using a mandrel to prevent tubular deformation can present difficulties, since the bent portion of the tube may pinch the mandrel and create difficulties in removing the mandrel.

SUMMARY OF THE INVENTION

The present invention provides a tube with a bent portion having a variable radius of curvature to reduce the abruptness of the variation of local bending stresses in the tube and thereby reduce the tendency of the bent portion of the tube to form oscillations or folds. The variable radius of curvature of the bend also reduces tubular deformation, which aids the removal of a mandrel from the bent portion of the tube.

The elongated tube is bent having a curved portion with a variable radius extending between first and second ends. The curved portion includes a circular arc portion with a constant radius and a clothoid transition portion with a variable radius. The circular arc portion extends from the first end toward a point of integration. At the point of integration, the circular arc portion merges with the transition portion. The transition portion extends from the point of integration to the second end. As the transition portion extends from the point of integration, its radius of curvature increases over its arc length.

The transition portion of the curve improves the quality of bent tubes by gradually bending the tube over a longer distance, thereby reducing local stresses on the bent portion of the tube. As a result, the amount of tube deformation and the number of oscillations or folds formed in the tube are reduced. The reduced number of oscillations and the reduction in tube deformation also reduces difficulties in removing a mandrel from the bent tube.

The tube may be bent using a modified rotary draw die having a variable radius of curvature. If desired, a mandrel may be inserted into the tube to further reduce deformation of the tube during the bending process.

These and other features and advantages of the invention will be more fully understood from the following description of certain specific embodiments of the invention taken together with the accompanying drawings.

DESCRIPTION OF THE PREFERRED EMBODIMENT

Figure 1:
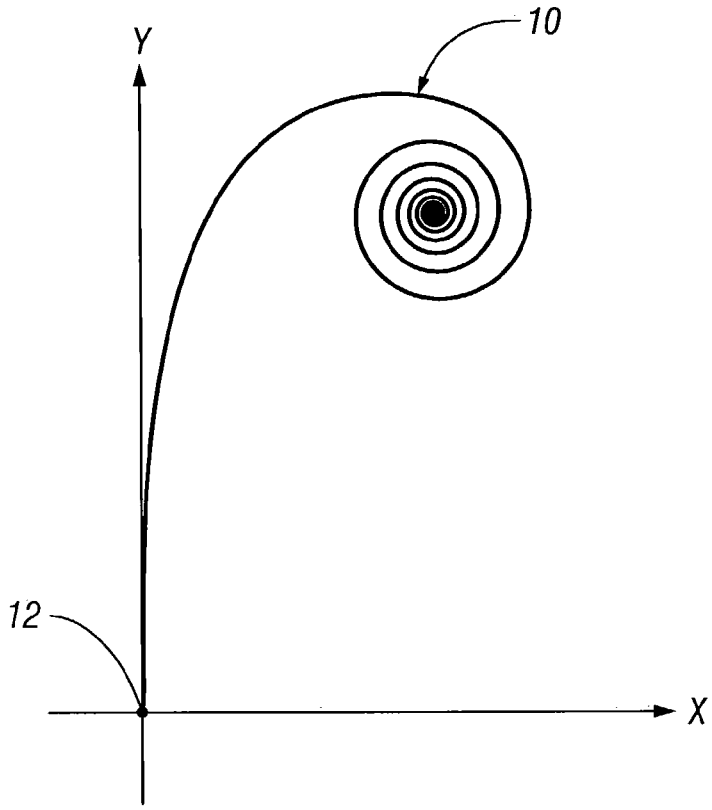
FIG. 1 is a graph plotting the shape of a clothoid.

Referring now to FIG. 1 of the drawings in detail, numeral 10 generally indicates a clothoid graphed along X, Y coordinates. The clothoid 10 originates at a point 0, 0 and extends into the positive X, Y quadrant. As the X, Y values increase, the shape of the clothoid 10 changes from a straight line with an infinite radius of curvature near its origin 12, to an arc having a decreasing radius of curvature which eventually spirals into a point.

Figure 2:
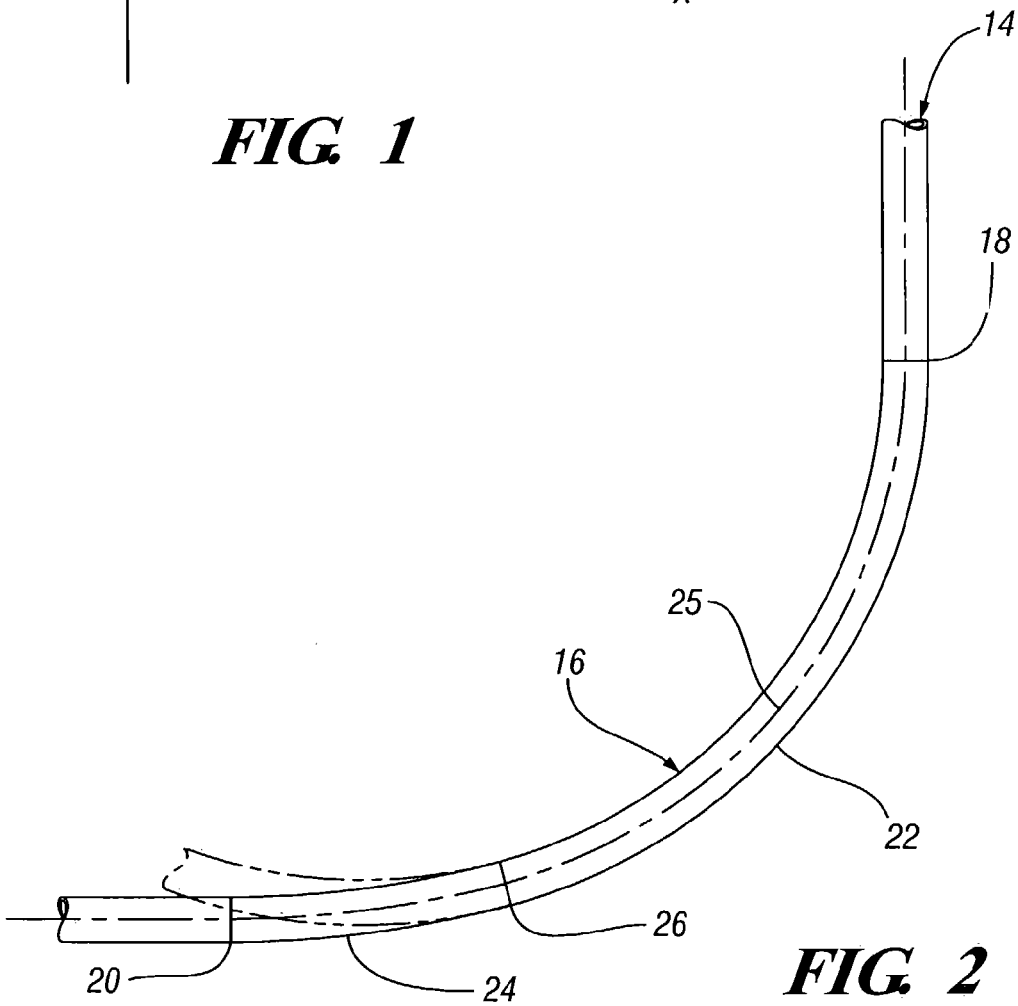
FIG. 2 is a diagrammatic view of an elongated tube having a circular arc portion and a clothoid transition portion extending from the circular arc to one end.

Referring now to FIG. 2, numeral 14 indicates a bent tube having a curved portion 16 bent at 90 degrees extending between first and second ends 18, 20. The curved portion 16 is made up of a circular arc portion 22 with a constant radius of curvature and a clothoid transition portion 24 with a variable radius of curvature. The circular arc portion 22 extends from the first end 18 or tangent point toward a point of integration 26. At the point of integration 26, the radius of curvature of the circular arc portion 22 is equal to the radius of curvature of the transition portion 24. As the transition portion 24 extends from the point of integration 26 toward the second end 20, the radius of curvature of the transition portion 24 increases until it becomes linear at the second end 20.

The shape and arc length of the transition portion 24 depends on the length of the curve 16 and the angle of the bend. The point of integration 26 may vary depending upon the desired application of the tube 14 and the angle of the bend in the curved portion 16.

Figure 3:
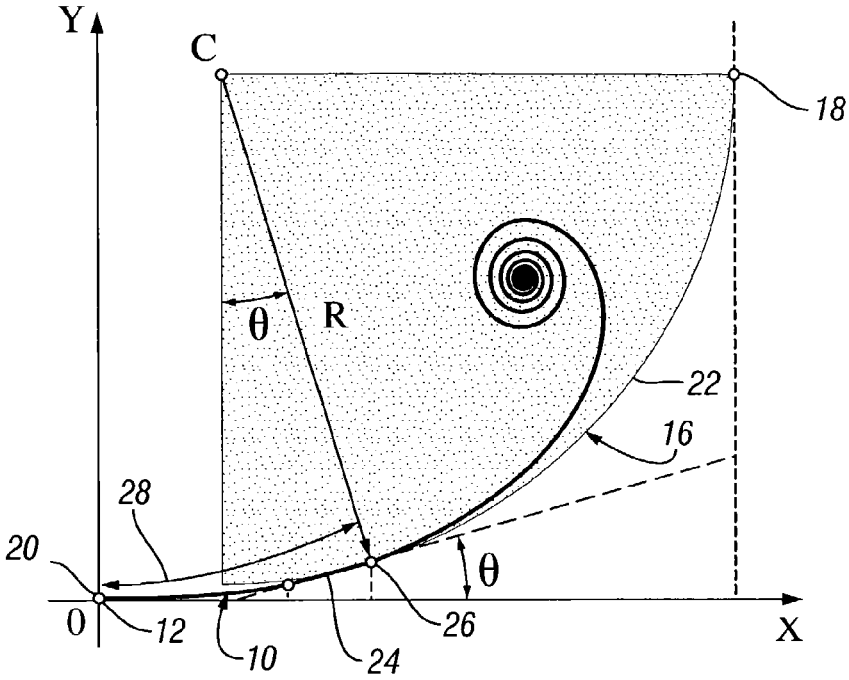
FIG. 3 is a diagrammatic view of the rotary draw die showing the 90 degree arc and the clothoid transition portion.

The graph shown in FIG. 3 illustrates the integration in the transition portion 24 of the clothoid 10 of FIG. 1 with the circular arc portion 22 of the tube 14 of FIG. 2 along an X, Y axis. The clothoid 10 extends between the second end 20 of the curve located at the origin 12 at coordinates 0,0 to the point of integration 26. The circular arc portion 22 extends from the point of integration 26 to the first end 18 of the curve 16.

The shape of the transition portion 24 is similar to the shape of the clothoid 10 between the origin 12 and the point of integration 26. The distance between the origin 12 and the point of integration 26 defines the arc length 28 of the clothoid 10 and the transition portion 24. The transition portion 24 has a variable radius of curvature over its arc length 28. Specifically, the radius of curvature of the transition portion 24 decreases along the clothoid 10 from the origin 12 toward the point of integration 26. At the point of integration 26, the radius of curvature of the transition portion 24 is equal to the radius of curvature of the circular arc portion 22.

The point of integration 26 may be at any point along the curve 16 between the first and second ends 18, 20. As the point of integration 26 moves toward the first end 18 of the curve 16, the arc length 28 of the clothoid transition portion 24 increases.

The curve 16 may be created by bending the tube 14 using a rotary draw die with a bending surface identical to curve 16 having a circular portion and a transition portion with a curvature that decreases linearly from the intended curvature of the circular portion to the zero curvature of a straight tube. If desired, a mandrel may be inserted into the tube to further reduce tubular deformation.

The transition portion 24 changes the centerline 25 of the bent tube from a circular arc to a straight line. As a result, the transition portion 24 of the curve 16 improves the quality of bent tubes by allowing the bending stresses to change over a longer distance, thereby easing the transition from straight at the second end 20 to the curved portion 16. Consequently, the amount of tubular deformation is minimized, and the number of oscillations or folds formed in the curved portion 16 are reduced. The reduced number of oscillations and the reduction in tube deformation also reduces difficulties in removing a mandrel from the bent tube.

Figure 4:
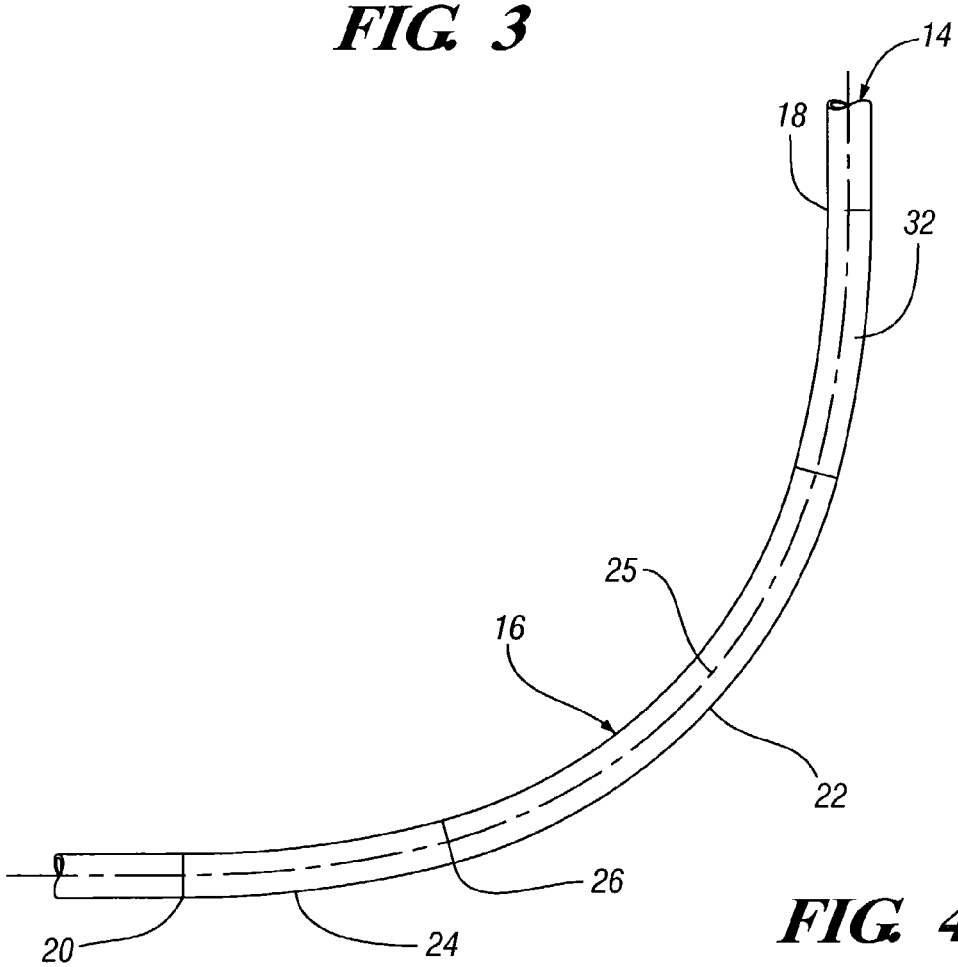
FIG. 4 is an alternative embodiment of a bent tube having multiple clothoids.

Alternatively, if desired, a second transition portion 32 may be integrated between the first and second ends 18, 20 of the curve 16 as shown in FIG. 4 to further reduce the local bending stresses on the tube 14.

The above described tube 14 has a bend configuration subtending 90 degrees. However, a tube may be bent having a bend configuration similar to tube 14 where the curve subtends greater or less than 90 degrees.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A draw die for tube bending, the die having a bending surface configuration comprising:

a curve extending between first and second ends;

a portion of the curve being a circular arc; and a clothoid transition portion extending from the second end toward the circular arc having a radius of curvature decreasing from zero curvature to a radius of curvature of the circular arc at a point of integration; and, including a second transition portion extending from the arc portion toward the first end having a curvature decreasing from the bending radius of the arc to the zero curvature.

2. The draw die of claim 1 wherein the curve subtends an angle of 90 degrees.

3. The draw die of claim 1 wherein the curve subtends an angle greater than 90 degrees.

4. The draw die of claim 1 wherein the curve subtends an angle less than 90 degrees.

5. The draw die of claim 1, wherein the shape and arc length of the transition portion is defined by a length and an angle of the portion of the curve being the circular arc.

* * * * *